US006152407A

United States Patent [19]

McKenzie

[11] Patent Number: 6,152,407

[45] Date of Patent: Nov. 28, 2000

[54] PLASTIC BAG CADDY

[75] Inventor: Thomas J. McKenzie, Tucson, Ariz.

[73] Assignee: McKenzie Product Co., Tucson, Ariz.

[21] Appl. No.: 09/398,154

[22] Filed: Sep. 16, 1999

Related U.S. Application Data

[60] Provisional application No. 60/101,102, Sep. 19, 1998.

[51] Int. Cl.[7] ..... B65B 67/12; B65B 55/04

[52] U.S. Cl. ..... 248/95; 248/97

[58] Field of Search ..... 248/97, 95, 99, 248/94, 100; 220/404

[56] References Cited

U.S. PATENT DOCUMENTS

| | | | |
|---|---|---|---|
| 4,316,591 | 2/1982 | Muraoka | 248/97 |
| 4,318,520 | 3/1982 | Walker | 248/97 |
| 4,407,474 | 10/1983 | Swenson | 248/97 |
| 4,664,347 | 5/1987 | Brown et al. | 248/97 |
| 4,907,710 | 3/1990 | Bulkens | 248/97 |
| 4,921,193 | 5/1990 | Benesch | 248/97 |
| 5,263,672 | 11/1993 | He | 248/97 |
| 5,711,499 | 1/1998 | Sectish | 248/97 |

*Primary Examiner*—Ramon O. Ramirez
*Assistant Examiner*—Jerome A. Deluca

[57] ABSTRACT

This Invention provides a stable stand-alone apparatus to hold and/or transport plastic shopping bags that are being reused as refuse containers. A shallow pan is formed as the base of this apparatus. The shallow base pan is complemented by two opposing sides each of which rises at a slight outward angle to two shoulders and a tapered neck. The opposing pliable handles of the plastic shopping bag are placed about the tapered necks and retained at these positions. This holds the pliable plastic shopping bag with its opening at shoulder level. The tapered necks each have an elongated hole to provide hand holds. This allows the user clean, safe and easy hand carry of refuse in the "The Plastic Bag Caddy" from an under sink cabinet or closet to another depository. The front and back areas above the shallow base pan are open. This allows expansion of the plastic bag as it is filled. It further allows a quick visual inspection of the fill level of the plastic bag and of any liquids that may have accumulated in the base pan.

6 Claims, 1 Drawing Sheet

PLASTIC BAG CADDY

This application claims benefit of Provisional Application Ser. No. 60/101,102 filed Sep. 19, 1998.

FIELD OF THE INVENTION

The present invention relates to the field of shopping bag holding apparatus. More particularly, the present invention relates to a self supporting, stand alone apparatus that can be placed in closets, under sink cabinets and the like.

BACKGROUND OF THE INVENTION

Known holders for pliable plastic shopping bags are made of wire; metal or plastic. Some can be folded while others are modified round and rectangular wastebasket containers. Most are too tall to fit in an under sink or lavatory cabinet. None offers a base pan which can hold spilled or leached liquids and additionally provide visible evidence of the same. Some offer a full view of the plastic shopping bag but do not position the plastic bag handles such that they create a wide rectangular opening at the top. The modified wastebasket containers do not allow for lateral expansion or for visual inspection to detect liquid accumulation and tearing of the pliable plastic shopping bag by sharp corners of inserted items.

Removal of a torn bag from these holders would result in the messy cleanup of liquids and/or solids. Other holders allow uncontrolled lateral expansion and lack liquid holding capability.

SUMMARY OF THE INVENTION

The object of the present invention is to provide a unique, user friendly, simple and inexpensive apparatus for holding plastic shopping bags for reuse This self supporting, stand alone device is easy to put into service. The user simply holds a pliable plastic shopping bag by the pair of integral handles and loops them over the necks of opposing risers. The handles are positioned at shoulders of the risers thereby opening the plastic shopping bag. The plastic shopping bag extends down between the risers to a point just above a base pan. "The Plastic Bag Caddy" is ready to serve as a receiver and holder of those items deposited by the user. Handles near the top of each riser provide easy and safe transport of accumulated refuse to an outdoor depository. The base pan provides containment for any liquids that may drip from refuse deposited in the plastic bag.

DETAILED DESCRIPTION OF THE INVENTION

The subject of this Invention is a formed plastic or metal stamped product that uniquely suspends plastic shopping bags for reuse as refuse or storage containers. "The Plastic Bag Caddy" is unique in a number of ways. A shallow base pan is complemented by two inclined side pieces that rise to shoulders. A neck portion further rises at the center of each of these inclined opposing sides. The plastic bag loops are retained at the shoulders. The plastic bag is, as a result, suspended over the shallow base pan ready to accept refuse.

The necked area is also provided with finger holds for hand carrying purposes. "The Plastic Bag Caddy" is sized to be placed in a household cabinet, in a room corner or against a wall. The shallow base pan provides a container for any liquids that may drip from containers placed in the suspended plastic bag. The front and back areas between the sides and above the shallow base pan are open. This allows for expansion of the plastic bag when it is being filled with refuse.

This open form also allows the fill condition of the plastic bag to be determined with a quick glance. "The Plastic Bag Caddy" is configured to be a stable, stand-alone device that can retain considerable refuse including small amounts of fluids. When it is full, it can be easily and safely carried by the finger holds to a larger indoor or outdoor disposal site.

Figure 1:
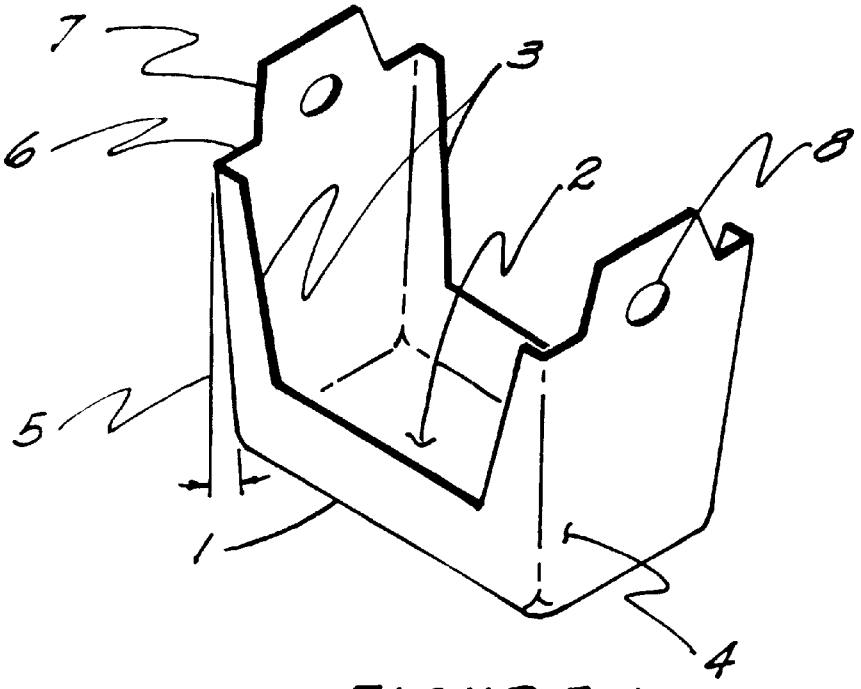
FIG. 1 shows "The Plastic Bag Caddy" standing alone without a plastic shopping bag.
Figure 2:
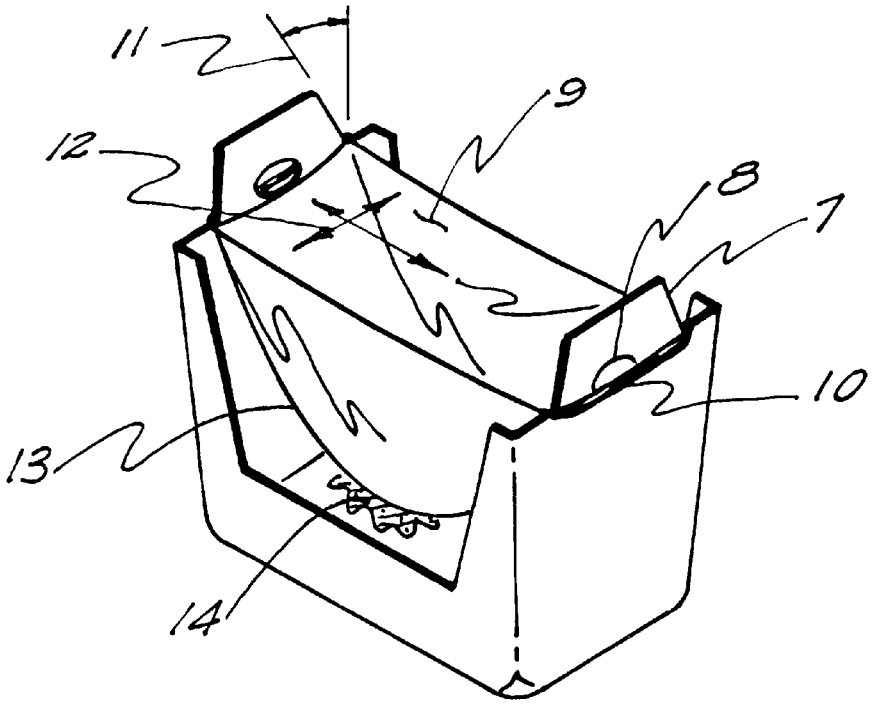
FIG. 2 shows "The Plastic Bag Caddy" with a plastic shopping bag held open for filling.

FIG. 1 is a view of a "The Plastic Bag Caddy" (1) without a plastic bag. This illustration provides a clear view of this product's structural features. The shallow base pan (2) provides a stable platform as well as the potential for liquid containment. The gussets (3) provide structural strength to the tapered side risers (4). These sides rise, at an outward angle (5) to one another, to the shoulder risers (6) where they step inward to create tapered neck risers (7) which are provided with the finger holds (8). FIG. 2 illustrates "The Plastic Bag Caddy" with a plastic bag (9) in place. The plastic bag handles (10) are placed about the opposing tapered neck risers (7) and rest at the opposing shoulders (6). The tapers (11) of the neck risers expand the plastic bag (9) widthwise. Furthermore, when the plastic bag handles (10) are placed over the tapered neck risers (7) the plastic bag (9) is expandable lengthwise. The result is a large rectangular opening (12) for easy access to the plastic bag (9). The part (13) of the plastic bag (9) attached to the plastic bag handles (10) is suspended above the shallow base pan (2) providing a clear view of any fluids (14) in the shallow base pan (2). The finger holds (8) make it possible to carry "The Plastic Bag Caddy" in the event fluids (14) are viewed in the shallow base pan (2).

"The Plastic Bag Caddy" is a stable, stand-alone device that employs a used plastic shopping bag. It can support and retain a considerable amount of refuse including items that have small amounts of fluids. The fluids will gravitate to the shallow base pan where they can be viewed and easily wiped clean. If there are fluids present, when the plastic bag is ready to be emptied, "The Plastic Bag Caddy" finger holds provide an easy and safe way to carry the refuse. When there are no fluids present, the plastic bag handles can be released from "The Plastic Bag Caddy" and tied together. The plastic bag can then be carried separately to a disposal site.

What is claimed is:

1. A holder for a flexible bag having a pair of handles for carrying the bag, said holder comprising:

a unitary body having a bottom wall, a pair of opposed first side walls extending from said bottom wall, and a pair of opposed second side walls extending from said bottom wall, said bottom wall and said side walls cooperating to define a compartment for the collection of fluids on said bottom wall, and each of said first side walls including a wider portion which extends from said bottom wall and has an end remote therefrom, each of said first side walls further including a narrower portion which projects from the remote end of the respective wider portion and is designed to have one of the bag handles placed thereover, and each of said wider portions cooperating with the respective narrower portion to define a pair of shoulders, each of said second side walls including a base portion which extends from said bottom wall partway to said shoulders, and each of said second walls further including two tapering portions which project from the respective base portion towards said shoulders and prevent excessive spreading of the bag when the bag is suspended from said narrower portions, the tapering portions of each second wall being spaced from one another to define an opening which permits viewing of said compartment so as to detect fluids which collect therein, and the tapering portions of each second wall widening in a direction towards the respective base portion to reinforce said body, each of said tapering portions having an edge which is remote from the respective base portion and makes at least approximately a right angle with a respective one of said shoulders to limit movement of the respective bag handles towards said bottom wall.

2. The holder of claim 1, wherein each of said narrower portions diverges in a direction towards the respective shoulders so that the bag is spread transverse to said second side walls when the bag handles are placed over said narrower portions.

3. The holder of claim 1, wherein said first side walls diverge from one another in a direction away from said bottom wall so that the bag is spread transverse to said first side walls when the bag handles are placed over said narrower portions.

4. The holder of claim 1, wherein each of said first side walls is provided with a handhold in the form of a hole.

5. The holder of claim 4, wherein at least part of each of said holes is located in the respective narrower portion to permit lifting of said body when the bag is suspended from said narrower portions.

6. The holder of claim 4, wherein said holes are elongated as considered in a direction from one of said second side walls towards the other.

* * * * *